US006095756A

United States Patent [19]

Fujita et al.

[11] Patent Number: 6,095,756

[45] Date of Patent: Aug. 1, 2000

[54] HIGH-CR PRECISION CASTING MATERIALS AND TURBINE BLADES

[75] Inventors: Akitsugu Fujita; Masatomo Kamada; Hiroshi Yokota; Mitsuyoshi Tsuchiya, all of Nagasaki; Yoshinori Tanaka, Tokyo, all of Japan

[73] Assignee: Mitsubishi Heavy Industries, Ltd., Tokyo, Japan

[21] Appl. No.: 09/034,065

[22] Filed: Mar. 3, 1998

[30] Foreign Application Priority Data

Mar. 5, 1997 [JP] Japan ..... 9-050428

[51] Int. Cl.[7] ..... B63H 1/26

[52] U.S. Cl. ..... 416/241 R; 415/200; 416/191; 420/64; 420/38; 420/106; 420/110; 148/325; 148/333

[58] Field of Search ..... 415/200; 416/181, 416/189, 190, 191, 192, 195, 232, 241 R; 420/64, 69, 106, 107, 109, 38, 110–111; 148/325, 333

[56] References Cited

U.S. PATENT DOCUMENTS

| | | | |
|---|---|---|---|
| 3,810,711 | 5/1974 | Emmerson et al. | 416/97 |
| 3,986,789 | 10/1976 | Pask | 415/178 |
| 4,218,178 | 8/1980 | Irwin | 415/114 |
| 4,693,667 | 9/1987 | Lenz et al. | 415/115 |
| 4,761,116 | 8/1988 | Braddy et al. | 416/92 |
| 4,844,755 | 7/1989 | Hashimoto et al. | 148/325 |
| 4,988,266 | 1/1991 | Nakamura et al. | 415/173.1 |
| 5,173,255 | 12/1992 | Ross et al. | 420/445 |
| 5,226,789 | 7/1993 | Donges | 415/189 |
| 5,310,431 | 5/1994 | Buck | 148/325 |
| 5,350,277 | 9/1994 | Jacala et al. | 416/90 R |
| 5,415,706 | 5/1995 | Scarlin et al. | 148/325 |
| 5,533,864 | 7/1996 | Nomoto et al. | 416/96 A |
| 5,749,228 | 5/1998 | Shiga et al. | 60/679 |
| 5,798,082 | 8/1998 | Kadoya et al. | 420/38 |
| 5,820,336 | 10/1998 | Hashimoto | 415/115 |

FOREIGN PATENT DOCUMENTS

| | | | |
|---|---|---|---|
| 04371552 | 12/1992 | Japan . | |
| 08333657 | 12/1996 | Japan . | |
| 09031600 | 2/1997 | Japan . | |
| 09059747 | 3/1997 | Japan . | |
| 2 111881A | 7/1983 | United Kingdom | 416/241 R |

*Primary Examiner*—Edward K. Look
*Assistant Examiner*—Matthew T. Shanley
*Attorney, Agent, or Firm*—Alston & Bird LLP

[57] ABSTRACT

This invention relates to high-Cr precision casting materials containing carbon, silicon, manganese, chromium, nickel, vanadium, niobium, nitrogen, molybdenum, tungsten, cobalt and optionally boron in specific weight proportions, the balance being iron and incidental impurities, as well as turbine blades made by a precision casting process using these materials. Thus, the present invention provides high-Cr precision casting materials which are capable of precision casting and, moreover, have excellent high-temperature strength, as well as inexpensive and highly reliable turbine blades made by using these casting materials and such turbine blades also having lighter weight.

2 Claims, 5 Drawing Sheets

HIGH-CR PRECISION CASTING MATERIALS AND TURBINE BLADES

FIELD OF THE INVENTION AND RELATED ART STATEMENT

This invention relates to high-Cr precision casting materials having excellent high-temperature properties and suitable for use as the materials of turbine blades and other components used in thermal electric power generation, as well as turbine blades made by using these casting materials as structural materials.

Turbine blade materials used for high-temperature applications in steam turbine plants for thermal electric power generation include forged steel materials based on 12Cr steel, and superalloys. Usually, such turbine blades for use in actual plants are being made by forging a stock while hot and then shaping it by cutting. In this manufacturing process, however, much material is shaved off and wasted because the stock is shaped by cutting. Moreover, since turbine blades have a complicated shape, a large number of cutting steps are required and, furthermore, electric discharge machining or other machining technique having low working efficiency must be employed for the shaping of an intricate cavity. Thus, an enormous cost and a considerable time have been required.

In contrast, the use of precision casting makes it easy to form a material into a shape similar to the desired one, so that its shaping can be performed at low cost. However, conventional casting materials have been inferior to forging materials in high-temperature strength as typified by creep rupture strength, and have failed to attain a sufficient strength for use as blade materials. In the prior art, therefore, precision casting materials have not been used as materials for the manufacture of moving blades for steam turbines and the like.

In addition, conventional blades such as moving blades for steam turbines all have a solid structure and hence weigh heavy. When such moving blades are rotated, a considerable load is imposed on the rotor supporting them. Consequently, it has been obliged to keep the operating temperature at a low level or use an expensive material such as 12Cr rotor material.

OBJECT AND SUMMARY OF THE INVENTION

In view of the above-described existing state of the prior art, an object of the present invention is to provide high-Cr precision casting materials which are capable of precision casting and, moreover, have excellent high-temperature strength, as well as inexpensive and highly reliable turbine blades made by using these casting materials and such turbine blades also having lighter weight.

In order to accomplish the above object, the present invention provides the following high-Cr precision casting materials (1) and (2) and turbine blades (3) to (5):

(1) A high-Cr precision casting material consisting essentially of, on a weight percentage basis, 0.08 to 0.14% carbon, 0.1 to 0.3% silicon, 0.01 to 1% manganese, 8.5 (inclusive) to 9.5% (not inclusive) chromium, 0.01 to 0.6% nickel, 0.1 to 0.2% vanadium, 0.03 to 0.06% niobium, 0.02 to 0.07% nitrogen, 0.1 to 0.7% molybdenum, 1 to 2.5% tungsten, 0.01 to 4% cobalt, and the balance being iron and incidental impurities.

(2) A high-Cr precision casting material consisting essentially of, on a weight percentage basis, 0.08 to 0.14% carbon, 0.1 to 10.3% silicon, 0.01 to 1% manganese, 8.5 (inclusive) to 9.5% (not inclusive) chromium, 0.01 to 0.6% nickel, 0.1 to 0.2% vanadium, 0.03 to 0.06% niobium, 0.02 to 0.07% nitrogen, 0.1 to 0.7% molybdenum, 1 to 2.5% tungsten, 0.01 to 4% cobalt, 0.002 to 0.01% boron, and the balance being iron and incidental impurities.

(3) A turbine blade made by a precision casting process using the aforesaid high-Cr precision casting material (1) or (2).

(4) A turbine blade having an airfoil of hollow structure, the turbine blade being made by a precision casting process using the aforesaid high-Cr precision casting material (1) or (2).

(5) A turbine blade obtained by making a turbine blade having airfoils of hollow structure and a shroud with a depression formed in the surface thereof according to a precision casting process using the aforesaid high-Cr precision casting material (1) or (2), and mounting a metallic plate (or shroud cover) in the depression of the shroud.

Figure 1:
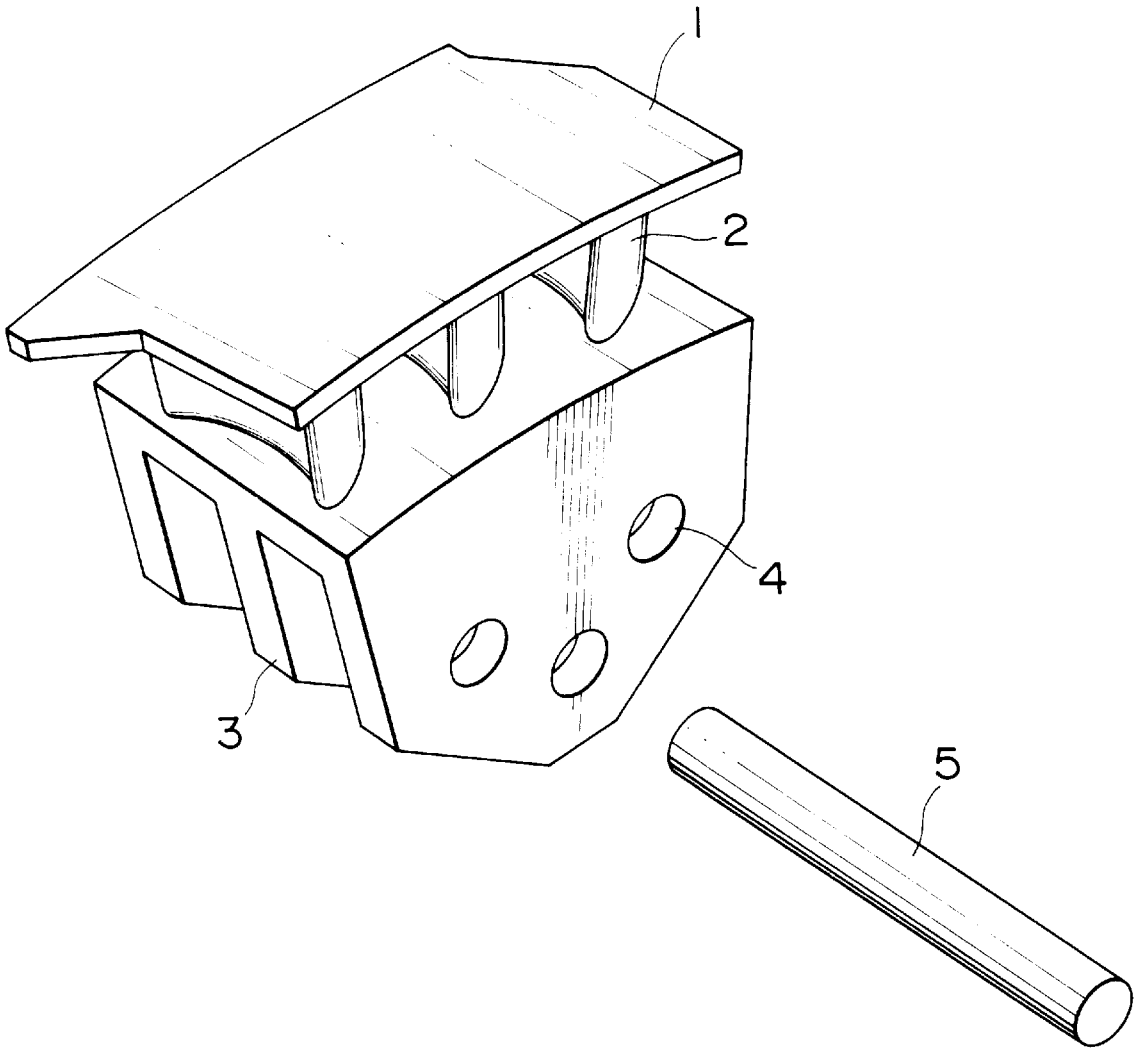
FIG. 1 is a schematic perspective view illustrating one embodiment of the turbine blade (3) of the present invention.

In the drawings, the definitions of reference numerals are as follows: 1, shroud; 2, airfoil (of solid structure); 3, root; 4, through hole; 5, straight pin; 6, airfoil cavity; 7, rotor; 8, shroud cover; 9, weld line; 10, depression.

DETAILED DESCRIPTION OF PREFERRED EMBODIMENTS

The aforesaid high-Cr precision casting materials (1) and (2) are based on the results of intensive investigations conducted by the present inventors in order to improve high-temperature strength by using a high-Cr steel as a basic material and adding carefully selected alloying elements thereto. Thus, these precision casting materials have excellent high-temperature properties and are suitable for use as the structural materials of steam turbine blades.

The reasons for content restrictions in the aforesaid high-Cr precision casting material (1) of the present invention are described below. In the following description, all percentages are by weight.

C (carbon): C, together with N, forms carbonitrides and thereby contributes to the improvement of creep rupture strength. Moreover, C acts as an austenite-forming element to inhibit the formation of δ-ferrite. If its content is less than 0.08%, no sufficient effect will be produced, while if its content is greater than 0.14%, the carbonitrides will aggregate during use to form coarse grains, resulting in a reduction in long-time high-temperature strength. In addition, high C contents will bring about poor weldability and may hence cause difficulties such as weld crack during the manufacture of precision-cast blades. For these reasons, C must not be added in an amount greater than that required to improve high-temperature strength by the formation of carbonitrides and to inhibit the formation of δ-ferrite. Accordingly, the content of C should be in the range of 0.08 to 0.14% and preferably 0.09 to 0.12%.

Si (silicon): Si is effective as a deoxidizer. Moreover, Si is an element required to secure good melt flowability because, for cast steel materials, the melt needs to be flow into all the corners of the mold. However, since Si has the effect of causing a reduction in toughness and high-temperature strength and, moreover, promoting the formation of δ-ferrite, it is necessary to keep its content as low as possible. If its content is less than 0.1%, sufficient melt flowability cannot be secured, while if its content is greater than 0.3%, difficulties as described above will manifest themselves. Accordingly, the content of Si should be in the range of 0.1 to 0.3% and preferably 0.15 to 0.25%.

Mn (manganese): Mn is an element which is useful as a deoxidizer. Moreover, Mn has the effect of inhibiting the formation of δ-ferrite. The formation of δ-ferrite will cause a reduction in ductility and toughness and, moreover, a significant reduction in creep rupture strength which is one type of high-temperature strength. Consequently, it is necessary to add Mn with consideration for the balance between Si and other elements. On the other hand, an increase in Mn will cause a corresponding reduction in creep rupture strength. On the basis of these background data, Mn must be added in a controlled amount so that the creep rupture strength will not be detracted from and, moreover, no δ-ferrite will be formed during the manufacture of large-sized cast steel articles. The addition of more than 1% of Si will cause a significant reduction in high-temperature strength, and the amount of Mn which is inevitably incorporated in steel materials is considered to be about 0.01%. Accordingly, the content of Mn should be in the range of 0.01 to 1% and preferably 0.03 to 0.6%.

Cr (chromium): Cr form a carbide and thereby contributes to the improvement of creep rupture strength. Moreover, Cr dissolves in the matrix to improve oxidation resistance and also contributes to the improvement of long-time high-temperature strength by strengthening the matrix itself. If its content is less than 8.5%, no sufficient effect will be produced. On the other hand, if its content is greater than 9.5%, the formation of δ-ferrite will tend to occur and cause a reduction in strength and toughness, though this may depend on other alloying elements. Accordingly, the content of Cr should be in the range of 8.5 (inclusive) to 9.5% (not inclusive) and preferably 8.7 to 9.3%.

Ni (nickel): Ni is an element which is effective in improving toughness. Moreover, Ni is useful in inhibiting the formation of δ-ferrite. However, since the addition of unduly large amounts of Ni will cause a significant reduction in creep rupture strength, it is desirable to add Ni in a required minimum amount. The addition of more than 0.6% of Ni will cause a significant reduction in creep rupture strength, and the amount of Ni which is inevitably incorporated in steel materials is considered to be about 0.01%. Accordingly, the content of Ni should be in the range of 0.01 to 0.6% and preferably 0.03 to 0.4%.

V (vanadium): V forms a carbonitride and thereby improves creep rupture strength. If its content is less than 0.1%, no sufficient effect will be produced. On the other hand, if its content is greater than 0.2%, the creep rupture strength will conversely be reduced. Accordingly, the content of V should be in the range of 0.1 to 0.2% and preferably 0.13 to 0.18%.

Nb (niobium): Nb forms a carbonitride and thereby contributes to the improvement of high-temperature strength. Moreover, Nb causes a finer carbide (M23C6) to precipitate at high temperatures and thereby contributes to the improvement of long-time creep rupture strength. If its content is less than 0.03%, no beneficial effect will be produced, while if its content is greater than 0.06%, the carbonitride of Nb formed during the manufacture of steel ingots will fail to dissolve fully in the matrix during heat treatment and will coarsen during use to cause a reduction in long-time creep rupture strength. Accordingly, the total content of Nb should be in the range of 0.03 to 0.06% and preferably 0.04 to 0.06%.

N (nitrogen): N, together with C and alloying elements, forms carbonitrides and thereby contributes to the improvement of high-temperature strength. Moreover, N is an important element in that it has the effect of inhibiting the formation of δ-ferrite. If its content is less than 0.02%, no sufficient amount of carbonitrides will be formed and, moreover, the effect of inhibiting the formation of δ-ferrite will not be fully achieved, resulting in insufficient creep rupture strength and poor toughness. If its content is greater than 0.07%, the carbonitrides will aggregate to form coarse grains after the lapse of a long time and, therefore, sufficient creep rupture strength cannot be achieved. Accordingly, the content of N should be in the range of 0.02 to 0.07% and preferably 0.03 to 0.06%.

Mo (molybdenum): Mo, together with W, dissolves in the matrix and thereby improves creep rupture strength. If Mo is added alone, it may be used in an amount of about 1.5%. However, where W is also added as is the case with the present invention, W is more effective in improving high-temperature strength. Moreover, if Mo and W are added in unduly large amounts, δ-ferrite will be formed to cause a reduction in creep rupture strength. Accordingly, with consideration for a balance with the content of W, the content of Mo should be in the range of 0.1 to 0.7%. In the material of the present invention to which an adequate amount of W is added, the content of Mo should be as low as possible from the viewpoint of cost. Consequently, the especially preferred range is from 0.1 to 0.5%.

W (tungsten): As described above, W, together with Mo, dissolves in the matrix and thereby improves creep rupture strength. As compared with Mo, W is a more effective element exhibiting a more powerful strengthening effect as a result of solid solution. However, if W is added in an unduly large amount, δ-ferrite and a large quantity of Laves phase will be formed to cause a reduction in creep rupture strength. Accordingly, with consideration for a balance with the content of Mo, the content of W should be in the range of 1 to 2.5% and preferably 1.5 to 2%.

Co (cobalt): Like Ni, Co dissolves in the matrix to inhibit the formation of δ-ferrite. However, Co does not reduce high-temperature strength as contrasted with Ni. Consequently, if Co is added, strengthening elements (e.g., Cr and W) can be added in larger amounts than in the case where no Co is added. As a result, high creep rupture strength can be achieved. However, the addition of unduly large amounts (in particular, more than 4%) of Co will promote the precipitation of a carbide and thereby cause a reduction in long-time creep rupture strength. Moreover, since Co itself is an expensive material, it is desirable from an economic point of view to add Co in as small an amount as possible. In the steels of the present invention to which Ni is added, about 0.01% of Co inevitably exists therein even if Co is not particularly added. Accordingly, the content of Co in the material of the present invention should be in the range of 0.01 to 4%. With consideration for cost and performance requirements, it is preferable to keep the content of Co as low as possible. Consequently, the especially preferred range is from 0.01 to 2%.

The high-Cr precision casting material having the above-defined composition has excellent high-temperature strength and, therefore, can be used to make various components requiring high-temperature strength according to a precision casting process. For example, since turbine blades which have conventionally been made by the cutting of a high-Cr forged steel material can be made according to a precision casting process, a marked reduction in term of works and manufacturing cost can be achieved.

Next, the reasons for content restrictions in the aforesaid high-Cr precision casting material (2) of the present invention are described below. This high-Cr precision casting material has the same composition as the aforesaid high-Cr precision casting material (1), except that boron is added thereto for the purpose of improving creep rupture strength. Accordingly, with respect to the components other than boron, the reasons for content restrictions are the same as described above and are hence omitted. Consequently, an explanation for boron is given below.

Boron (B): B has the effect of enhancing grain boundary strength and thereby contributes to the improvement of creep rupture strength. However, if B is added in unduly large amounts, the toughness will be reduced. On the other hand, if the content of B is less than 0.002%, it will fail to produce a sufficient effect. Accordingly, the content of B in the material of the present invention should be in the range of 0.002 to 0.01%.

In addition to the excellent properties possessed by the aforesaid high-Cr precision casting material (1) of the present invention, the high-Cr precision casting material (2) having the above-defined composition shows a further improvement in creep rupture strength.

Now, the turbine blades (3) to (5) of the present invention are more specifically described below with reference to the accompanying drawings.

The turbine blade (3) of the present invention may be made by forming the above-described high-Cr casting material (1) or (2) of the present invention into a turbine blade of predetermined shape according to a precision casting process. FIG. 1 is a schematic perspective view illustrating one embodiment of the turbine blade (3) of the present invention. The turbine blade of FIG. 1 comprises a block composed of a shroud 1, three airfoils 2 and a root 3. This turbine blade may be connected to a rotor by boring through holes in root 3 constituting the lower part of the blade, and anchoring root 3 to the rotor with straight pins 5 inserted into these through holes 4. More specifically, the rotor (not shown) also has through holes at the same positions as through holes 4, and root 3 is connected to the rotor by the expansion fitting of straight pins 5. In this embodiment, airfoils 2 have a solid structure.

This turbine blade is formed of a material having excellent high-temperature strength, and hence exhibits high reliability. Moreover, since this turbine blade is made by precision casting, the term of works and the manufacturing cost can be markedly reduced as compared with the conventional cutting process using a high-Cr forged steel material.

In the turbine blade (4) of the present invention, the weight of airfoils 2 has been reduced by forming a cavity 6 in each airfoil 2. Since this can also reduce the stress produced at the root of the blade, the thickness of the root can be made smaller. As a result, moving blades having much lighter weight (e.g., by more than 10%) than ones of solid structure can be made. Eventually, the stress applied to the rotor can also be reduced by more than 10%.

In the case of rotating turbine blades such as moving blades, the load imposed on the rotor supporting the blades can be reduced by reducing the weight of the material thereof. That is, the centrifugal force F produced by the rotation of a structure is represented by the following equation: $F=mV^2/r$ where m is the mass, V is the rotational speed, and r is the radius of gyration. Thus, since the stress applied to the rotor is increased in proportion to the mass of the moving blades, a reduction in the mass of the moving blades leads directly to a decrease in the stress applied to the rotor. However, iron-based materials have a specific gravity of about 7.8 and undergo no substantial change even if the contents of alloying elements are modified. It is evident from this fact that the weight of a blade could not be reduced without decreasing the volume of the blade itself.

Figure 2:
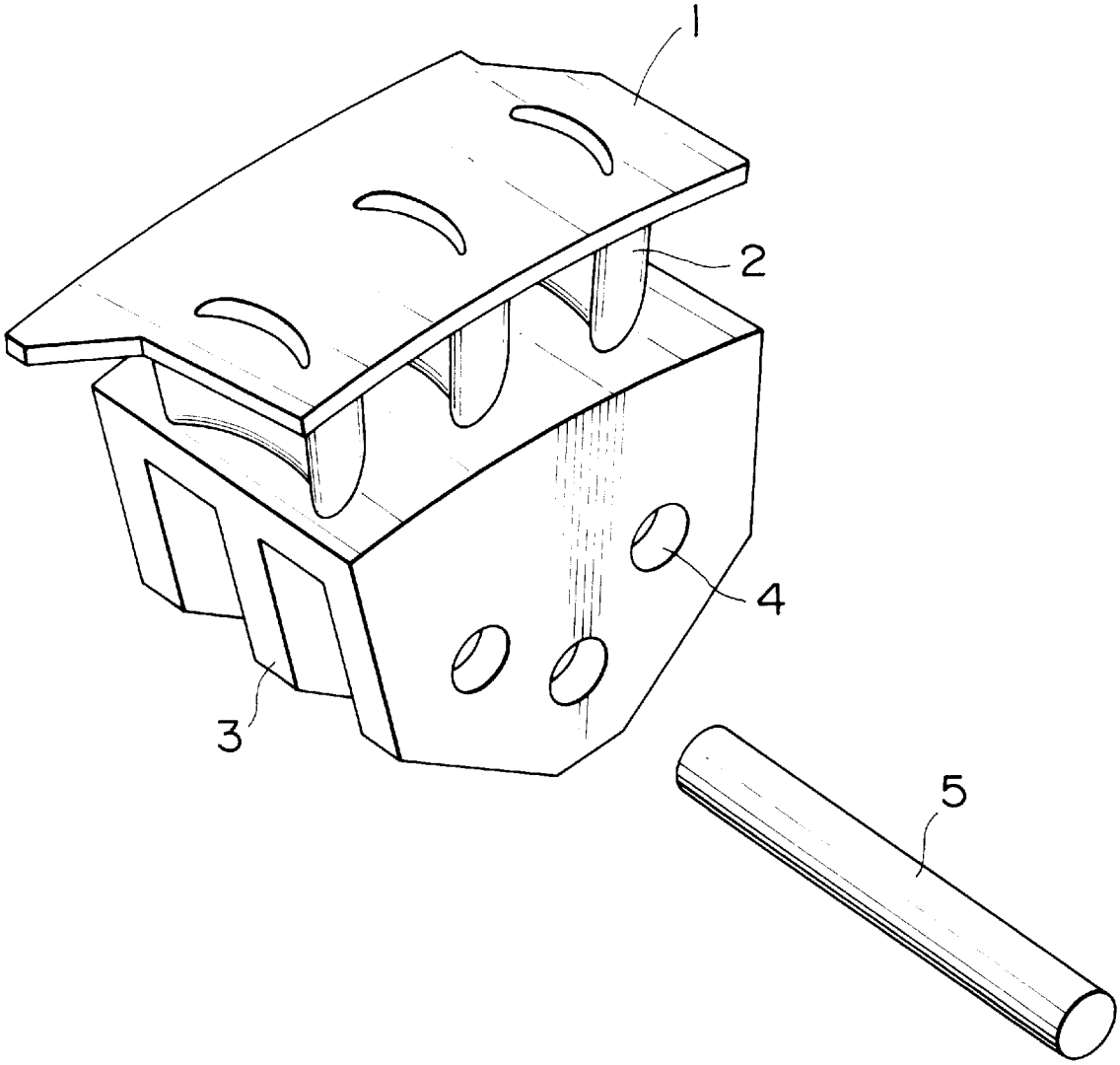
FIG. 2 is a schematic perspective view illustrating one embodiment of the turbine blade (4) of the present invention.
Figures 3A, 3B:
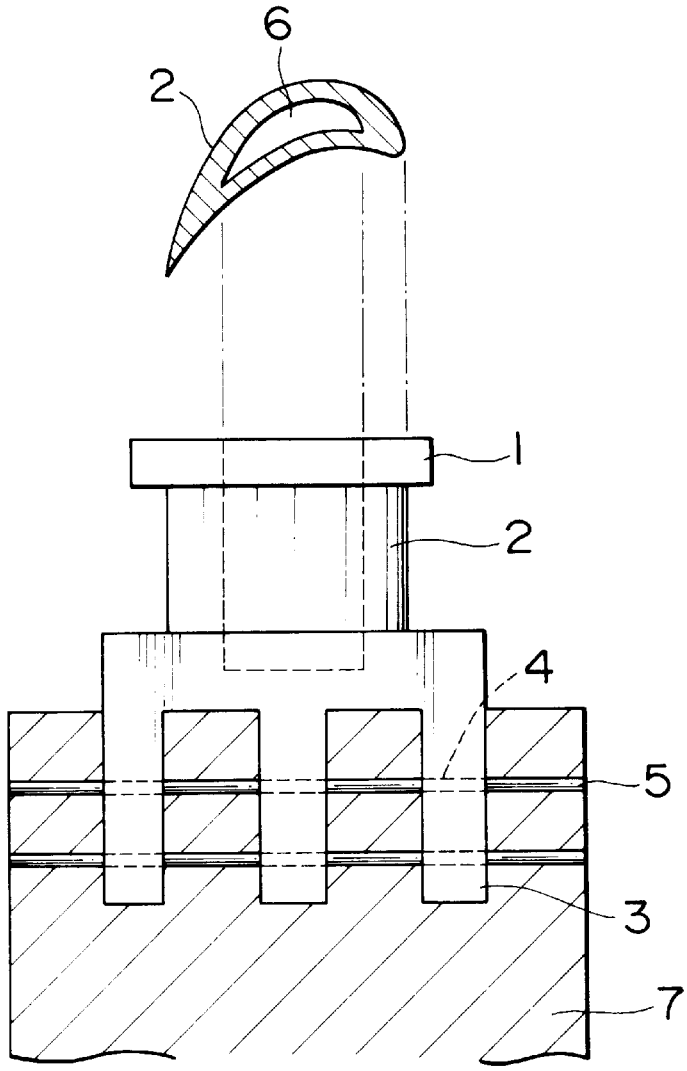
FIG. 3A is a view showing the cross-sectional shape of an airfoil as illustrated in FIG. 2.
FIG. 3B is a view showing the manner in which the turbine blade of FIG. 2 is anchored to a rotor.

FIG. 2 is a schematic perspective view illustrating one embodiment of the turbine blade (4) of the present invention, and FIG. 3(*a*) is a view showing the cross-sectional shape of an airfoil. As shown in FIG. 3B, the turbine blade of this embodiment may be anchored to a rotor by inserting straight pins 5 into through holes 4 bored in root 3 and rotor 7. Moreover, in this turbine blade, each airfoil 2 have a cavity 6 formed therein for the purpose of reducing its weight, as illustrated in FIG. 3A. This hollow structure makes it possible to achieve a reduction in the weight of airfoils. Moreover, the reduction in the weight of airfoils 2 causes a decrease in centrifugal force, so that the thickness of root 3 can be made smaller. This causes a further reduction in weight. Eventually, the overall weight of the blade can be reduced by more than 10%. It is to be understood that, from the viewpoint of strength, the airfoils of hollow structure involve no problem because the strength of the blade itself can be sufficiently retained by the outer shells.

In addition to the effects possessed by the turbine blade (3) of the present invention, the turbine blade (4) of the present invention is reduced in weight and hence makes it possible to relax the strength requirements for the rotor supporting the blade. Consequently, an inexpensive material may be used for the rotor. Thus, the present invention is also highly effective in reducing the cost of the rotor material. That is, the technique of the present invention which makes it possible to reduce the weight of blades may be said to be an epoch-making technique which makes it possible to improve the reliability of turbines and provide inexpensive turbine equipment.

When the weight of the blade is reduced by using airfoils of hollow structure as in the turbine blade (4) of the present invention, a precision casting process causes the cavities of the airfoils to remain open to the surface of the shroud as illustrated in FIG. 2. The resulting holes of shroud 1 have little direct influence on the operation of the turbine and may hence be left as they are. However, from the viewpoint of thermal efficiency, they produce disturbances in a flow of fluid around the outer periphery of the blade and thereby cause a reduction in thermal efficiency though it is slight. For this reason, it is desirable to close the hole of shroud 1 as far as possible.

Figure 5:
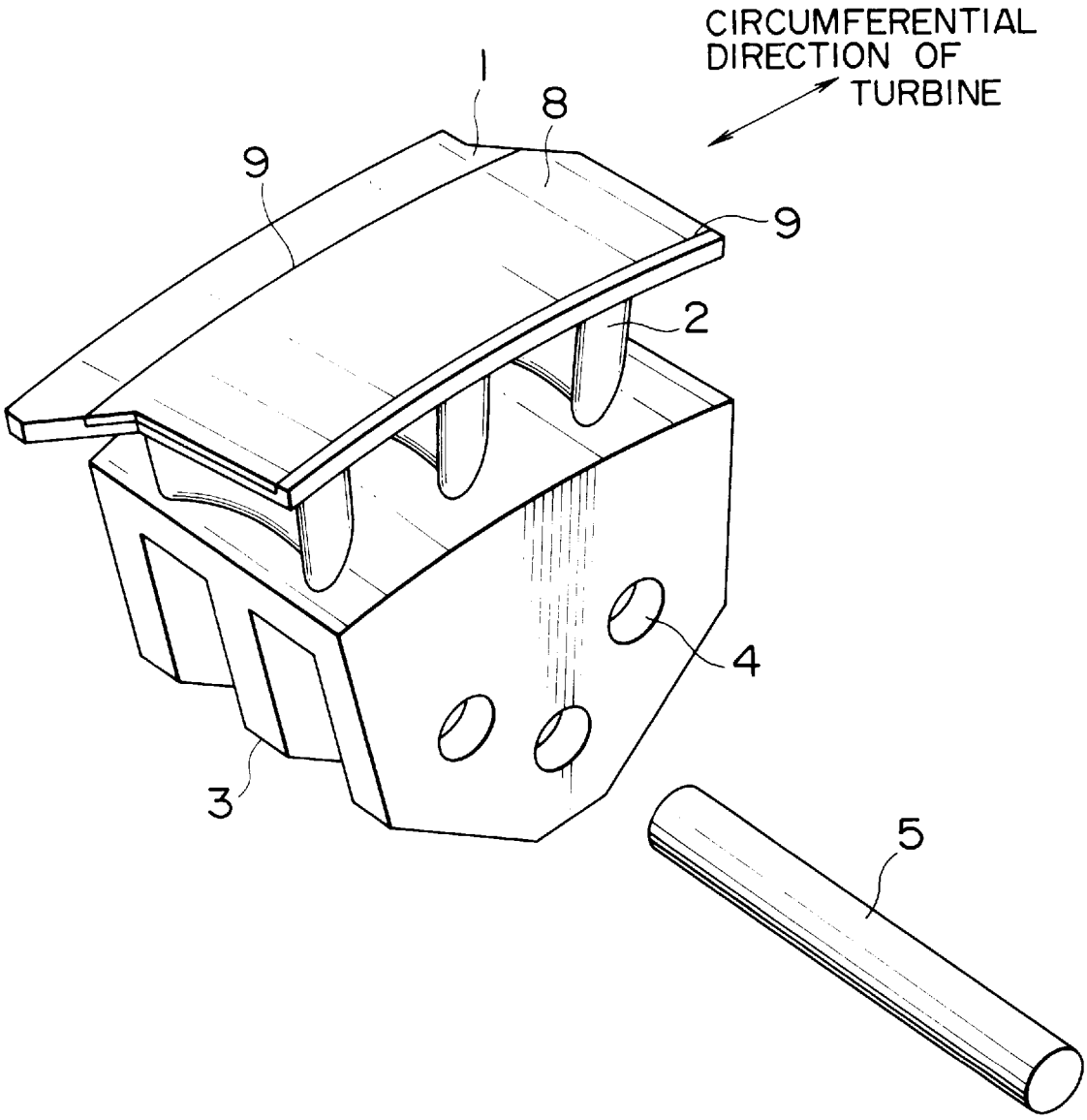
FIG. 5 is a schematic perspective view illustrating the turbine blade (5) of the present invention in which a shroud cover is mounted in the depression of the shroud.

The aforesaid turbine blade (5) of the present invention is a turbine blade having airfoils of hollow structure in which the surface thereof is made smooth by forming a depression 10 in the shroud and mounting a metallic plate (or shroud cover) 8 in this depression by a suitable means such as electron beam welding. In FIG. 5, the line segment with arrow heads indicates the circumferential direction of the turbine.

Figure 4:
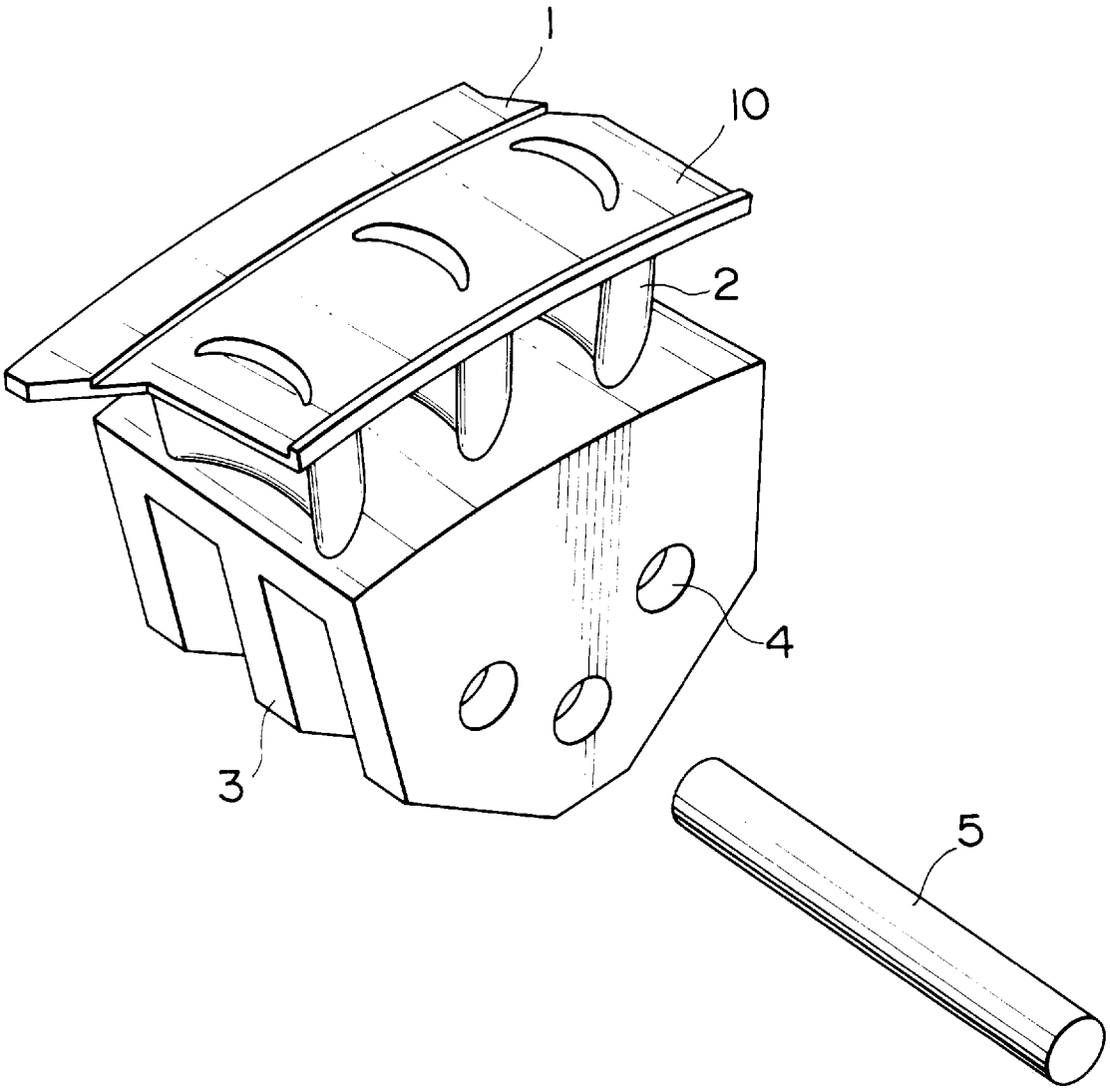
FIG. 4 is a schematic perspective view illustrating the turbine blade (5) of the present invention in which the shroud has a depression formed in the surface thereof.

One embodiment of the turbine blade (5) of the present invention in which the shroud has a depression formed in the surface thereof is illustrated in the schematic perspective view of FIG. 4, and the turbine blade of FIG. 4 in which a metallic plate (or shroud cover) is mounted in the depression of the shroud is illustrated in the schematic perspective view of FIG. 5. The turbine blade of this embodiment has such a structure that, in forming a blade shape according to a precision casting process, shroud 1 is provided with a depression 10 as illustrated in FIG. 4 so as to permit a shroud cover 8 comprising a metallic plate to be mounted on shroud 1. The mounting of shroud cover 8 on shroud 1 can be achieved by a welding process such as electron beam welding. The material of shroud cover 8 may be any material that can withstand the centrifugal force due to its self-weight at temperatures of 600° C. or below. On the basis of the fact that a high-Cr casting steel material is used for the moving blade, any type of material having high-temperature strength of not less than SUS410 class as specified by the Japanese Industrial Standards may be used without causing any particular problem.

Moreover, since the welded joints of shroud cover 8 only need to withstand the centrifugal force due to its self-weight, sufficient strength will be achieved by welding shroud cover 8 along two weld lines 9 extending in the circumferential direction of the turbine.

Consequently, in addition to the effects possessed by the turbine blade (4) of the present invention, the turbine blade (5) of the present invention has the effect of eliminating disturbances in a flow of fluid around the outer periphery of the blade as observed in the case in which the cavities of the airfoils are open to the surface of the shroud, and thereby preventing a reduction in thermal efficiency.

The above-described high-Cr casting material (1) of the present invention has been developed by using a high-Cr steel as a basic material and modifying the contents of various ingredients, and hence has excellent high-temperature strength. By using this high-Cr casting material (1), various components requiring high-temperature strength can be made by precision casting. For example, when this high-Cr casting material is used as the structural material of turbine blades, they can be made by a precision casting process in place of the conventional cutting process using a high-Cr forged steel material. Consequently, a significant reduction in term of works and manufacturing cost can be achieved.

In addition to the effects possessed by the aforesaid high-Cr casting material (1) of the present invention, the high-Cr casting material (2) of the present invention to which boron is added shows a further improvement in creep rupture strength.

The turbine blade (3) of the present invention is formed of a material having excellent high-temperature strength, and hence exhibits high reliability. Moreover, since this turbine blade may be made by precision casting, it can be made with a shorter term of works and at a less manufacturing cost as compared with conventional blades made by the cutting of a high-Cr forged steel material.

In the turbine blade (4) of the present invention, its airfoils are modified so as to have a hollow structure. Thus, in addition to the effects possessed by the turbine blade (3) of the present invention, this turbine blade has the effect of being reduced in weight. Moreover, the lighter weight of the blade makes it possible to relax the strength requirements for the rotor supporting the blade. Consequently, an inexpensive material may be used for the rotor, resulting in a reduced cost of the rotor material.

In the turbine blade (5) of the present invention, the surface thereof is made smooth by forming a depression in the shroud and mounting a shroud cover in this depression. Consequently, in addition to the effects possessed by the turbine blade (4) of the present invention, this turbine blade has the effect of eliminating disturbances in a flow of fluid around the outer periphery of the blade as observed in the case in which the cavities of the airfoils are open to the surface of the shroud, and thereby preventing a reduction in thermal efficiency.

One preferred embodiment of the present invention is explained below with reference to the accompanying drawings. However, it is to be understood that the present invention is not limited thereto. In order to demonstrate the effects of the present invention, the following examples are given.

EXAMPLE 1

With respect to the aforesaid high-Cr casting material (1) of the present invention, a series of test materials were prepared and tested to evaluate various properties thereof. The chemical compositions of the materials used for these tests are shown in Table 1. All test materials were prepared by melting the ingredients in a vacuum high-frequency furnace and then pouring the resulting melt into a ceramic mold formed by a lost wax process.

These test materials were heat-treated by heating them at 1,050° C. for 5 hours and then air-cooling them to 150° C. or below. Then, they were tempered at their respective tempering temperatures which had been determined so as to give a 0.2% yield strength of about 70–80 kgf/mm$^2$.

The inventive materials (1) (test material Nos. 1–7) and comparative materials (test material Nos. 11–18) so prepared were subjected to room-temperature tension tests and impact tests. Moreover, the creep rupture strengths of these test materials after being held at 600° C. for 100,000 hours were determined by extrapolation. The results thus obtained are shown in Table 2. As is evident from the results of the room-temperature tension tests, the ductility (as expressed by elongation and reduction of area) and impact value of the inventive materials are stably higher. In contrast, the ductility and toughness of the comparative materials are relatively lower. Moreover, it can be seen that the creep rupture strength of the inventive materials is much more excellent than that of the comparative materials.

TABLE 1

| Group | Test material No. | C | Si | Mn | Cr | Ni | V | Nb | Mo | W | Co | N |
|---|---|---|---|---|---|---|---|---|---|---|---|---|
| Inventive materials (1) | 1 | 0.12 | 0.19 | 0.60 | 9.3 | 0.48 | 0.12 | 0.04 | 0.32 | 2.1 | 1.5 | 0.052 |
| | 2 | 0.13 | 0.15 | 0.03 | 8.5 | 0.55 | 0.12 | 0.04 | 0.27 | 1.8 | 1.9 | 0.064 |
| | 3 | 0.13 | 0.14 | 0.90 | 8.6 | 0.06 | 0.13 | 0.05 | 0.32 | 1.8 | 1.9 | 0.050 |
| | 4 | 0.09 | 0.19 | 0.55 | 9.1 | 0.54 | 0.14 | 0.05 | 0.32 | 2.2 | 3.8 | 0.067 |
| | 5 | 0.14 | 0.12 | 0.61 | 8.7 | 0.60 | 0.14 | 0.06 | 0.29 | 2.1 | 0.5 | 0.069 |
| | 6 | 0.12 | 0.26 | 0.34 | 9.2 | 0.56 | 0.19 | 0.06 | 0.31 | 1.7 | 1.7 | 0.035 |
| | 7 | 0.12 | 0.18 | 0.63 | 9.3 | 0.55 | 0.13 | 0.05 | 0.29 | 2.2 | 3.5 | 0.054 |
| Comparative materials | 11 | 0.11 | 0.18 | 0.60 | 10.6 | 0.21 | 0.14 | 0.05 | 0.20 | 0.6 | 0.5 | 0.013 |
| | 12 | 0.25 | 0.38 | 1.06 | 9.1 | 0.40 | 0.18 | 0.09 | 0.83 | 2.9 | 1.8 | 0.082 |
| | 13 | 0.06 | 0.28 | 0.15 | 9.5 | 0.16 | 0.17 | 0.05 | 0.45 | 2.8 | 0.5 | 0.026 |
| | 14 | 0.09 | 0.65 | 0.56 | 9.4 | 0.44 | 0.25 | 0.04 | 0.56 | 1.2 | 1.0 | 0.045 |
| | 15 | 0.07 | 0.45 | 0.04 | 9.2 | 0.05 | 0.22 | 0.05 | 0.33 | 2.0 | 0.1 | 0.032 |
| | 16 | 0.10 | 0.36 | 0.46 | 8.4 | 0.54 | 0.15 | 0.04 | 0.06 | 1.5 | 1.2 | 0.055 |
| | 17 | 0.11 | 0.28 | 0.68 | 9.1 | 0.85 | 0.15 | 0.04 | 0.54 | 1.3 | 5.5 | 0.065 |
| | 18 | 0.13 | 0.29 | 0.88 | 9.2 | 0.68 | 0.08 | 0.04 | 0.08 | 1.5 | 4.2 | 0.054 |

20

TABLE 2

| | | Room-temperature tension test | | | | 2 mm V-notched | 600° C. × $10^5$ hour |
|---|---|---|---|---|---|---|---|
| Group | Test material No. | 0.2% yield strength (kgf/mm$^2$) | Tensile strength (kgf/mm$^2$) | Elongation (%) | Reduction of area (%) | impact value at 20° C. (kgf-m) | creep rupture strength (kgf/mm$^2$) |
| Inventive materials (1) | 1 | 75.4 | 88.2 | 21.6 | 65.4 | 6.8 | 15.4 |
| | 2 | 74.3 | 87.9 | 20.3 | 66.6 | 5.9 | 15.8 |
| | 3 | 75.1 | 88.0 | 24.5 | 68.2 | 6.6 | 15.4 |
| | 4 | 75.3 | 88.1 | 23.8 | 67.8 | 6.7 | 16.8 |
| | 5 | 74.8 | 88.3 | 23.4 | 68.8 | 6.2 | 15.3 |
| | 6 | 74.6 | 88.0 | 21.6 | 66.5 | 7.0 | 16.3 |
| | 7 | 75.0 | 88.1 | 23.8 | 67.6 | 8.0 | 16.7 |
| Comparative materials | 11 | 75.6 | 88.3 | 21.6 | 59.8 | 2.7 | 10.4 |
| | 12 | 74.4 | 87.8 | 18.8 | 55.4 | 1.1 | 10.2 |
| | 13 | 73.2 | 86.8 | 21.2 | 62.3 | 1.8 | 10.8 |
| | 14 | 74.9 | 88.4 | 19.2 | 57.2 | 4.5 | 10.0 |
| | 15 | 75.2 | 88.2 | 17.6 | 58.8 | 1.2 | 11.5 |
| | 16 | 75.4 | 87.9 | 18.3 | 57.4 | 4.3 | 11.2 |
| | 17 | 75.1 | 88.5 | 19.5 | 60.2 | 4.5 | 9.8 |
| | 18 | 75.0 | 87.6 | 20.2 | 63.8 | 7.1 | 9.0 |

EXAMPLE 2

With respect to the aforesaid high-Cr casting material (2) of the present invention, a series of test materials were prepared and tested to evaluate various properties thereof.

The chemical compositions of the materials used for these tests are shown in Table 3. The preparation and heat treatment of the test materials were carried out in the same manner as in Example 1.

The inventive materials (2) (test material Nos. 21–25) so prepared were subjected to room-temperature tension tests and impact tests in the same manner as in Example 1. Moreover, the creep rupture strengths of the inventive materials (2) after being held at 600° C. for 100,000 hours were determined by extrapolation. The results thus obtained are shown in Table 4. In Tables 3 and 4, data on test material Nos. 1, 4, 5 and 7 included in the inventive materials (1) obtained in Example 1 are also shown for purposes of comparison.

As shown in Table 4, there is no difference between the inventive materials (1) and (2) in room-temperature tensile properties and impact properties. Thus, no influence of the addition of boron is recognized. However, it can be seen that the creep rupture strength of the inventive materials (2) to which boron is added is further improved as compared with the inventive materials (1) to which no boron is added.

TABLE 3

| Group | Test material No. | C | Si | Mn | Cr | Ni | V | Nb | Mo | W | Co | B | N |
|---|---|---|---|---|---|---|---|---|---|---|---|---|---|
| Inventive materials (1) | 1 | 0.12 | 0.19 | 0.60 | 9.3 | 0.48 | 0.12 | 0.04 | 0.32 | 2.1 | 1.5 | — | 0.052 |
| | 4 | 0.09 | 0.19 | 0.55 | 9.1 | 0.54 | 0.14 | 0.05 | 0.32 | 2.2 | 3.8 | — | 0.067 |
| | 5 | 0.14 | 0.12 | 0.61 | 8.7 | 0.60 | 0.14 | 0.06 | 0.29 | 2.1 | 0.5 | — | 0.069 |
| | 7 | 0.12 | 0.18 | 0.63 | 9.3 | 0.55 | 0.13 | 0.05 | 0.29 | 2.2 | 3.5 | — | 0.054 |
| Inventive materials (2) | 21 | 0.12 | 0.18 | 0.62 | 9.2 | 0.46 | 0.12 | 0.04 | 0.31 | 2.1 | 1.4 | 0.003 | 0.053 |
| | 22 | 0.09 | 0.19 | 0.57 | 9.1 | 0.56 | 0.13 | 0.04 | 0.34 | 2.2 | 3.7 | 0.006 | 0.064 |
| | 23 | 0.13 | 0.13 | 0.61 | 8.8 | 0.60 | 0.14 | 0.05 | 0.29 | 2.1 | 0.7 | 0.005 | 0.068 |
| | 24 | 0.12 | 0.18 | 0.65 | 9.3 | 0.54 | 0.13 | 0.05 | 0.27 | 2.2 | 3.5 | 0.007 | 0.052 |
| | 25 | 0.13 | 0.14 | 0.64 | 9.1 | 0.50 | 0.14 | 0.05 | 0.35 | 1.8 | 1.7 | 0.009 | 0.051 |

TABLE 4

| | | Room-temperature tension test | | | | 2 mm V-notched | 600° C. × $10^5$ hour |
|---|---|---|---|---|---|---|---|
| Group | Test material No. | 0.2% yield strength (kgf/mm$^2$) | Tensile strength (kgf/mm$^2$) | Elongation (%) | Reduction of area (%) | impact value at 20° C. (kgf-m) | creep rupture strength (kgf/mm$^2$) |
| Inventive materials (1) | 1 | 75.4 | 88.2 | 21.6 | 65.4 | 6.8 | 15.4 |
| | 4 | 75.3 | 88.1 | 23.8 | 67.8 | 6.7 | 16.8 |
| | 5 | 74.8 | 88.3 | 23.4 | 68.8 | 6.2 | 15.3 |
| | 7 | 75.0 | 88.1 | 23.8 | 67.6 | 8.0 | 16.7 |
| Inventive materials (2) | 21 | 75.1 | 88.1 | 22.0 | 66.4 | 7.3 | 16.8 |
| | 22 | 74.8 | 88.0 | 22.6 | 68.2 | 7.1 | 18.2 |
| | 23 | 75.3 | 88.2 | 20.8 | 69.0 | 6.8 | 16.8 |
| | 24 | 74.3 | 87.8 | 21.4 | 68.5 | 8.2 | 18.0 |
| | 25 | 74.9 | 88.3 | 23.8 | 67.5 | 8.3 | 17.2 |

What is claimed is:

1. A turbine blade made by a precision casting process using a high-Cr precision casting material consisting essentially of, on a weight percentage basis, 0.08 to 0.14% carbon, 0.15 to 0.25% silicon, 0.01 to 1% manganese, 8.5 (inclusive) to 9.5% (not inclusive) chromium, 0.01 to 0.6% nickel, 0.1 to 0.2% vanadium, 0.03 to 0.06% niobium, 0.02 to 0.07% nitrogen, 0.1 to 0.7% molybdenum, 1 to 2.5% tungsten, 0.01 to 4% cobalt, and the balance being iron and incidental impurities, wherein the turbine blade has an airfoil of hollow structure and a shroud with a depression formed in the surface thereof, and a metallic plate in the depression of the shroud.

2. A turbine blade made by a precision casting process using a high-Cr precision casting material consisting essentially of, on a weight percentage basis, 0.08 to 0.14% carbon, 0.15 to 0.25% silicon, 0.01 to 1% manganese, 8.5 (inclusive) to 9.5% (not inclusive) chromium, 0.01 to 0.6% nickel, 0.1 to 0.2% vanadium, 0.03 to 0.06% niobium, 0.02 to 0.07% nitrogen, 0.1 to 0.7% molybdenum, 1 to 2.5% tungsten, 0.01 to 4% cobalt, 0.002 to 0.01% boron, and the balance being iron and incidental impurities, wherein the turbine blade having an airfoil of hollow structure and a shroud with a depression formed in the surface thereof, and a metallic plate in the depression of the shroud.

* * * * *